US006260323B1

(12) United States Patent
Hockey

(10) Patent No.: US 6,260,323 B1
(45) Date of Patent: Jul. 17, 2001

(54) WALL PANEL SUPPORT UNIT AND WALL SYSTEM

(76) Inventor: Charles R. Hockey, 4301 Timberview, Howell, MI (US) 48843

( * ) Notice: Subject to any disclaimer, the term of this patent is extended or adjusted under 35 U.S.C. 154(b) by 0 days.

(21) Appl. No.: 09/325,787

(22) Filed: Jun. 4, 1999

(51) Int. Cl.[7] ..... E04B 2/28

(52) U.S. Cl. ..... 52/481.1; 52/238.1; 52/483.1; 52/508; 52/536; 52/537; 52/591.4; 52/783.1

(58) Field of Search ..... 52/238.1, 481.1, 52/483.1, 508, 536, 537, 783.11, 630, 591.4

(56) References Cited

U.S. PATENT DOCUMENTS

| | | | | |
|---|---|---|---|---|
| 631,940 | | 8/1899 | Rapp . | |
| 782,810 | | 2/1905 | Murphy et al. . | |
| 1,068,542 | | 7/1913 | Stewart . | |
| 2,019,707 | * | 11/1935 | Jenkins | 52/783.11 X |
| 2,039,601 | | 5/1936 | London . | |
| 2,576,530 | | 11/1951 | Medal . | |
| 2,893,008 | | 7/1959 | Gagnon . | |
| 3,360,892 | | 1/1968 | Rosso . | |
| 3,657,849 | * | 4/1972 | Garton | 52/537 X |
| 3,802,147 | | 4/1974 | O'Konski . | |
| 4,453,364 | | 6/1984 | Ting . | |
| 4,507,901 | | 4/1985 | Carroll . | |
| 4,546,590 | * | 10/1985 | Finch et al. | 52/536 X |
| 4,881,355 | | 11/1989 | Bosl et al. . | |
| 5,067,296 | | 11/1991 | Brown et al. . | |
| 5,165,213 | * | 11/1992 | Finch et al. | 52/536 X |
| 5,469,674 | | 11/1995 | Morello . | |
| 5,579,615 | * | 12/1996 | Hoffman | 52/537 X |
| 5,581,969 | | 12/1996 | Kelleher . | |
| 5,706,614 | * | 1/1998 | Wiley, Jr. et al. | 52/537 X |
| 5,855,099 | * | 1/1999 | Hoffman | 52/537 X |

* cited by examiner

*Primary Examiner*—Christopher T. Kent
(74) *Attorney, Agent, or Firm*—Douglas S. Bishop

(57) ABSTRACT

A wall panel supporting unit and system of constructing a wall utilizing a series of the wall panel supporting units in place of a traditional stud wall. The individual wall panel supporting units are of unitary construction and are generally rectangular. The units are corrugated and the resulting ridges function in the same manner as individual studs in a traditional wall, by creating a space within the wall for insulation, electrical wiring and similar uses. The individual units are fastened together, and attached to parallel tracks along the ceiling and floor to ensure a straight wall when panel sheathing such as drywall is applied. The individual units generally conform to each other when stacked together and offer a significant reduction in required shipping space.

17 Claims, 3 Drawing Sheets

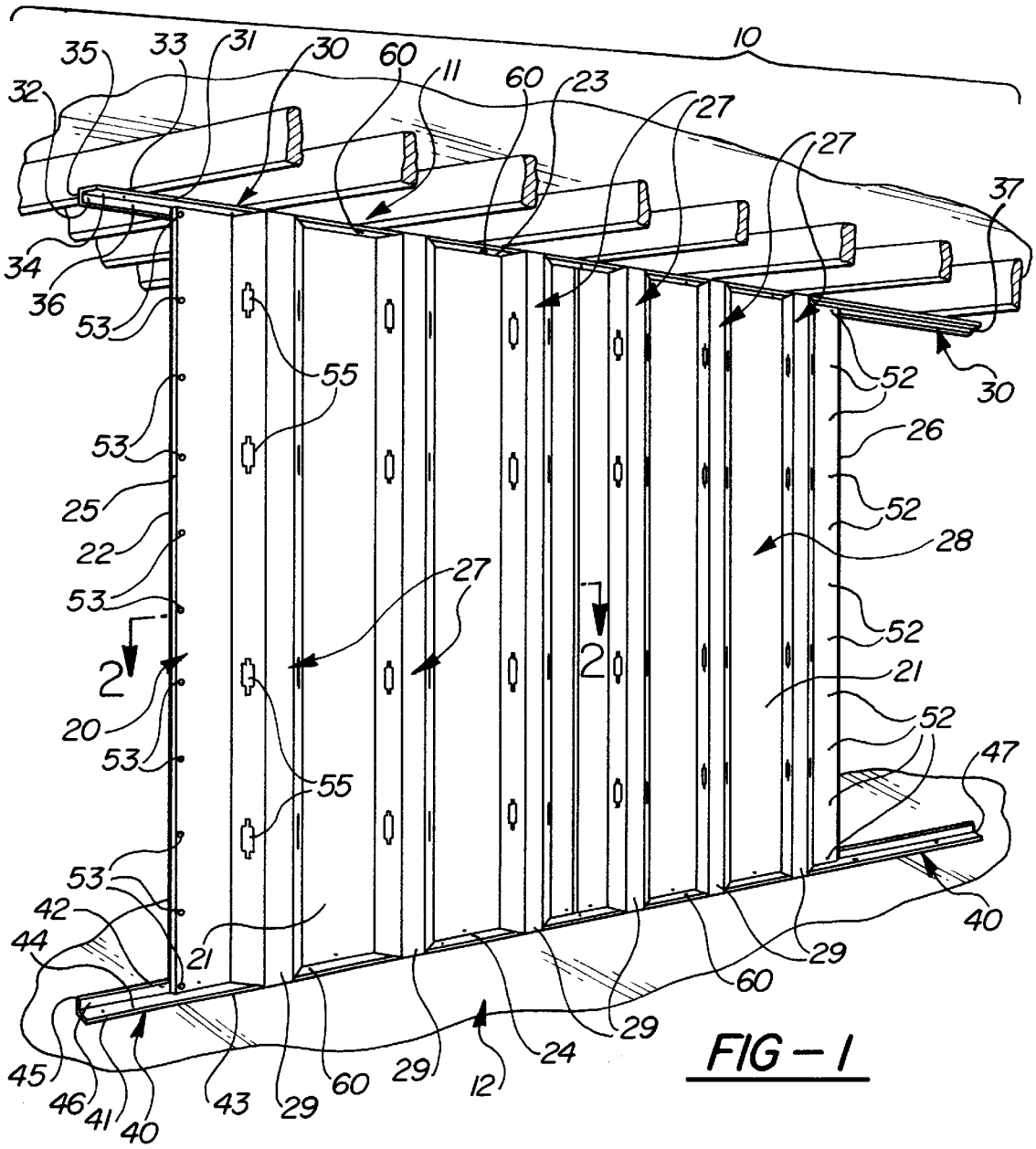
FIG-1
FIG-2
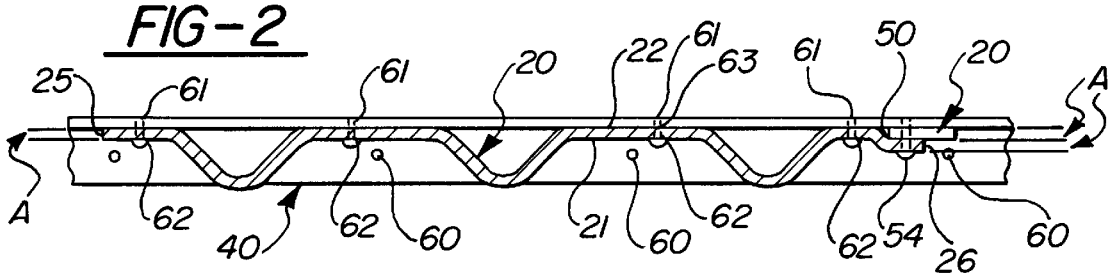

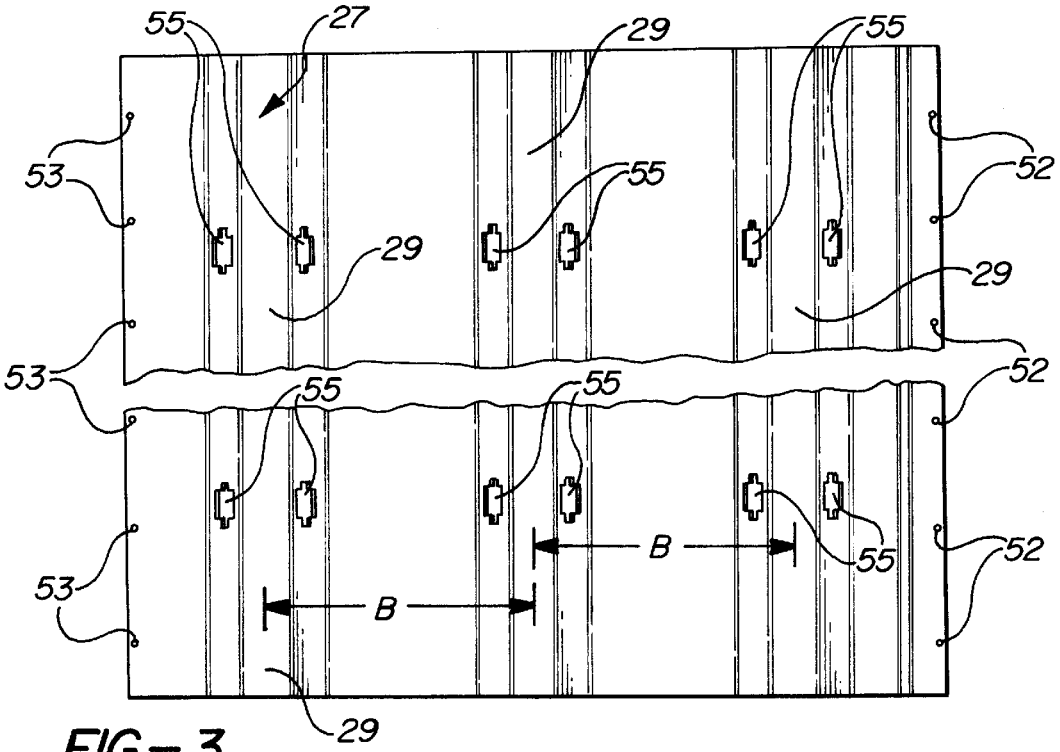
FIG-3
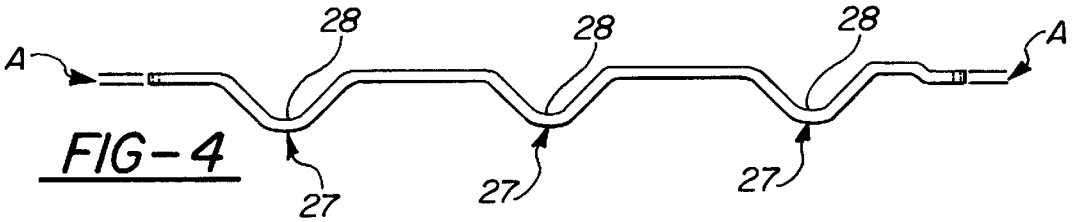
FIG-4
FIG-5
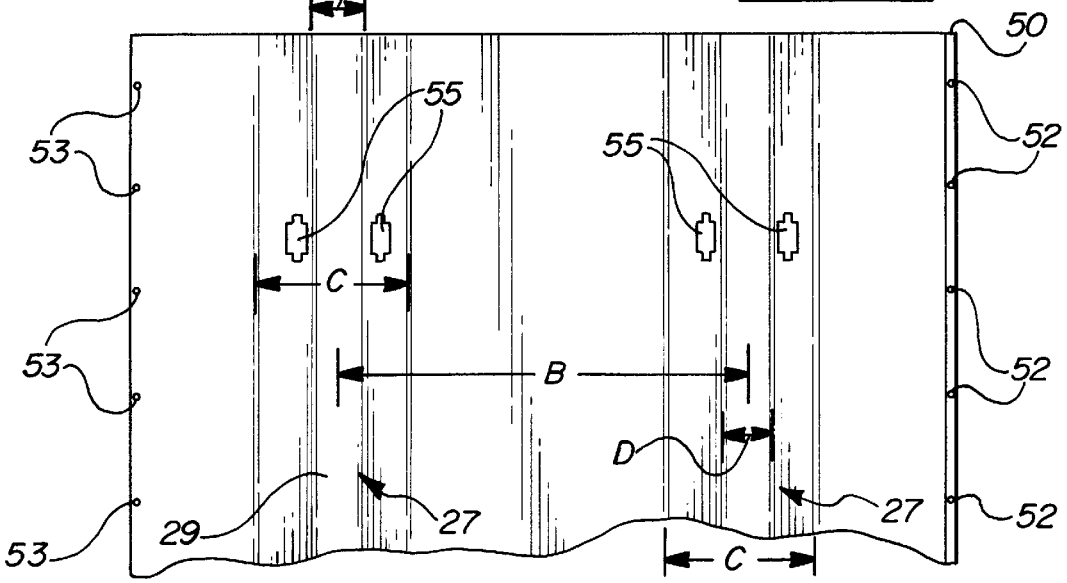

WALL PANEL SUPPORT UNIT AND WALL SYSTEM

BACKGROUND OF THE INVENTION

This invention relates to wall construction and units utilized in that construction and, more specifically, to prefabricated wall panel support units for construction of a rough wall, or of a wall structure to support wall panels in the interior of a building. The present invention relates, specifically, to the construction of walls, interior to a structure having a defined ceiling or overhead, and a defined floor.

The concept of building an interior wall by utilization of a frame, upon which to attach wall panels, including drywall, or like materials, is a method historically long known. Traditionally, such walls are constructed of wood, perhaps most commonly 2×4 "studs" which are fabricated on site, with upright studs located at desired uniform intervals, for the attachment of drywall or other wall panel type material. Even predating the days of drywall, lath construction across the exterior of the studs, in the wall assembly, was utilized to provide a base for a plaster wall.

Traditional wall stud construction poses a number of problems, some particular to the novice, and some, to novice or skilled tradesman alike. First, utilization of individual units of 2×4 or other uniform sized lumber requires fabrication on site and a significant degree of skill, often putting this technique beyond the capabilities of anyone but the professional tradesman. While prefabricated stud wall units are known, these are cumbersome and heavy, and present difficulties in transportation and storage. Another obstacle to overcome in traditional stud wall assembly is the inherent variation in the material itself. Even high grade lumber presents some variation from piece to piece and is subject to warping when exposed to the elements, or variation in humidity and/or temperature exposure. Further, utilization of the very highest grade lumber for construction of wall panel support walls (stud walls) would be prohibitively expensive. It is difficult, therefore, with traditional construction methods, to create a wall panel support wall which is linearly straight, and uniform, from its base at the floor, to the ceiling. The same considerations that apply to the straightness of the walls, and the linear smoothness from floor to ceiling also apply, obviously, to thickness of walls, which are not always uniform utilizing traditional stud wall construction methods.

Utilization of prefabricated stud walls likewise does not address or solve all of the previous problems. As previously stated prefabricated stud walls, of traditional materials, present significant obstacles in shipping and storage, and, further, are dependent upon the composition of the base material which, usually, is wood. The variation in the base materials, in stud walls, has been addressed somewhat, in utilization of metal studs, as well. However, on-site construction using metal studs places utilization even further out of the reach of anyone but the skilled tradesman, and prefabricated metal stud walls present like difficulties in transportation and storage. Further, utilization of prefabricated individual panels does not eliminate the subjectivity of placement and alignment and, therefore, does not ensure that a combination of panels, when installed, will be linearly, or vertically, true.

Numerous examples which attempt to address portions of this problem exist in the prior art. U.S. Pat. No. 5,581,969, issued to Kelleher, for a prefabricated building element, discloses a modular building panel member having one or more V-shaped reinforcing stud members; U.S. Pat. No. 2,576,530, issued to Medal, discloses a construction panel composed of a pair of plywood sheets or other like materials glued or otherwise affixed about a thin corrugated sheet. U.S. Pat. No. 5,067,296, to Brown et al, discloses a modular insulated wall panel system utilizing preconstructed wall panel elements. The use of corrugated steel sheets in floor construction, for receiving a concrete, cement, or plaster slurry, is also disclosed by U.S. Pat. No. 3,802,147, to O'Konski.

While all of the referenced prior art discloses attempts which, in some respect, address one or more problems related to traditional stud wall or wall panel support, none of the prior art provides, or teaches, a wall component, or system of wall construction, which adequately addresses the combined concerns of on-site assembly which is both horizontally and vertically true, ease in storage and maintenance, both from a weight and volume standpoint, and which is susceptible to utilization by persons other than skilled tradesman.

Accordingly, a need exists for a prefabricated construction unit, capable of supporting a sheet of wall panel material, such as drywall, fabricated wood paneling or like materials, which panel units are of unitary, manufactured construction, to ensure uniformity within required tolerances and which, when installed in combination, will provide a true wall support unit, both vertically and horizontally.

Further, a need exists, for a wall construction system utilizing uniform panels, which is susceptible of uniform and correct installation by persons with less than optimal trade experience and which provides a means for easily joining uniform support units or panels A further need exists to supply a prefabricated wall panel support unit for utilization in such wall construction system which, without sacrificing required support strength, is optimally lightweight and conformed to be stackable, for ease and efficiency in shipment and storage, both on and off the construction site.

As noted, the existing prior art does not satisfy these requirements.

SUMMARY OF THE INVENTION

The present invention has been designed to overcome shortcomings in the prior art and to address the needs as noted above. The present invention is directed to the provision of a prefabricated unit, to be utilized in series, in wall construction, to support finished wall panels, and, a system of wall construction utilizing such panels, to allow a person of ordinary skill to assembly, on site, an interior support wall between an existing floor and ceiling, which wall is uniformly true, both vertically and horizontally, and in width.

More specifically, the present invention is directed to a system of wall construction, and a primary unit within that system which is of unitary manufactured construction, and which may be extruded, from various materials, to provide uniform construction parameters in width, height and length, as well as optimizing, by selection of the appropriate materials, and design of the unit itself, the strength to weight ratio of the unit and to allow a prefabricated wall unit which may be conformably stacked, for optimum efficiency in shipping and storage, both on and off site.

According to an important feature of the invention, there is provided a support unit which, within the system of wall construction, may be joined in series, and to which a wall sheathing of panels of different composition, including drywall or wood paneling, may be attached. This support unit is constructed of an extruded material which may be metal, composite, or synthetic material, which forms a rigid sheet. In general, the outward dimensions of the sheet are rectangular, although the sheet, itself, along its vertical surface, is uniformly corrugated to provide a series of ridges on one side and corresponding furrows on the other. The ridges are uniformly spaced and have at least a partially flat extended outer surface, to which the wall sheathing may be attached. In general, the vertical ridges of the corrugated construction are parallel, and may be spaced as desired, in traditional on center spacings, as normally utilized in construction. In practice, the panels may be of traditional 4×8 foot construction, but may, as desired, be of any particular dimension. As is evident from the stated corrugated construction, on the opposite side of each panel, for each corrugated ridge, there is a corresponding corrugated furrow. The corrugated construction is such that, when a combination of support panels are stacked, the corrugated ridges of each panel conformably fit, when so stacked, within the corrugated furrows of the preceding panel, to maximize space efficiency in shipping, handling and storage. As stated, the construction of the support units is substantially rectangular, and the vertical furrows and ridges are parallel to the vertical sides of the panel. The upper edges and lower edges of the panel are essentially parallel to each other, and the profile of the panel, from the front, is generally rectangular.

According to an important feature of the invention, each support panel is conformed so that it is uniformly mateable with another like support panel, in order to form a continuous support wall. This is accomplished by recessing an adjacent area of the panel along one vertical edge, parallel to the corrugated ridges. The adjacent panel area is recessed, in its entirety, so that one side of the panel area is recessed and the opposite side of the panel area extended a distance equal to the thickness of the panel, which is substantially uniform thereout, including through the corrugated portion. Accordingly, the other vertical edge of a like panel, parallel to the corrugated ridges, may then be placed over the recessed area of the initial panel so that the top edges of the panels so mated are linearly aligned to form a straight line, with the exception of the corrugated ridges and furrows and which, when so aligned, provide a uniform supporting surface between both panels, susceptible of mounting a continuous straight sheath of drywall or other wall panel material. Each of the corrugated ridges additionally has a flat exterior linear surface running between the top edge and bottom edge of the panel unit to facilitate attachment of the wall sheathing material. This flat surface on each of the corrugated ridges is parallel to the rectangular profile of the support unit.

According to a further important feature of the invention, in order to ensure uniformity in construction, each support unit or panel has a series of uniform, pre-drilled holes, each running vertically between the upper and lower surfaces adjacent to and parallel to each vertical edge. These holes, at one edge, will be through the recessed vertical area, and each pre-drilled hole along the recessed area will correspond in vertical distance from the top and bottom of the panel with a pre-drilled hole along the other edge so that, when the non-recessed edge of a support panel is mated with the recessed edge of another like support panel, so that the top edge and lower edge are in common, the pre-drilled holes of each panel will be aligned with each other to allow the panels to be fixed together by a bolt, screw, or other fastening means inserted through one or more of the pairs of aligned pre-drilled holes.

According to a further important feature of the invention, in order to facilitate the stated conformity of like panels for stacking purposes, the corrugated ridges on each panel are progressively narrower in extension from the surface of the panel to the exterior flat surface of the ridge, while maintaining the uniform thickness of the panel through the corrugated areas.

According to a further important feature of the invention, the wall assembly system portion of the invention includes a series of the stated support panels, joined as stated, and further includes a pair of corresponding tracks, one track affixed to the ceiling or overhead of the area in which the wall is being constructed, and the other corresponding track being affixed to the floor surface of the area in which the wall is being constructed. These two tracks are aligned in vertical parallel to ensure linear straightness in the constructed wall. Typically, these supports may be formed of elongated members having two elongated flat sides joined at a common edge in what is typically understood as an L-shaped or "angle iron" configuration. As to the ceiling track, one flat side of the track is attached to the ceiling or overhead so that the other second flat portion of the track extends a distance vertically downward and linearly along the length of the track. Likewise, for the floor track, one flat surface is affixed to the floor surface with the other flat surface extending upward, and linearly along the track. Each support unit is then attached along its upper edge, sequentially, to the downward extending portion of the upper track and each support unit, sequentially, is attached along its lower edge to the upward protruding portion of the lower track.

According to a further feature of the invention, each support unit may include pre-drilled holes parallel to and along its upper edge, in areas of the support unit which are not corrugated, and likewise may have pre-drilled holes parallel to and adjacent to its lower edge, in areas which are not corrugated. Likewise, the downward extending portion of the upper track and the upward extending portion of the lower track may have pre-drilled holes at designated intervals so that, when each panel of the unit is sequentially placed against the upper and lower tracks, one or more of the pre-drilled holes along the support unit's upper edge will correspond with one or more pre-drilled holes in the upper track and, likewise, one or more pre-drilled holes along the lower edge of the support unit will correspond with one or more of the pre-drilled holes in the lower track, so that a bolt, screw, or other fastening means may be inserted through the corresponding, or aligned, holes to secure each support unit, sequentially, to the upper and lower tracks.

According to a further feature of the invention, each of the support units has a series of openings extending along each side of the corrugated ridges and corresponding furrows, between the upper edge of the support unit and the lower edge of the support unit. These openings may be utilized for the passage of electrical conduit, attachment of wall panel fasteners, telephone, computer or other utility installation, or the like. Ideally, these openings are arranged so that they correspond and are horizontally aligned, on each side of the ridge.

As stated, the individual support units may be constructed of any suitable material and may be of metal, composite construction, plastic polymer, or other synthetic material.

The above and additional features of the invention may be considered and will become apparent in conjunction with the drawings in particular, and the detailed description which follows.

BRIEF DESCRIPTION OF THE DRAWINGS

The following detailed description is best understood by reference to the following drawings, in which:

FIG. 1 is a perspective view of a partially completed wall assembly in the preferred embodiment;

FIG. 2 is a top cross-sectional view taken on line 2—2 of FIG. 1;

FIG. 3 is a fragmented front view of an individual wall panel support unit having three corrugated ridges;

FIG. 4 is a top view of an individual wall panel support unit and corresponding furrows having three corrugated ridges and showing the uniform thickness of the unit;

FIG. 5 is a fragmented front view of an individual wall panel support unit having a pair of corrugated ridges;

DETAILED DESCRIPTION OF THE PREFERRED EMBODIMENT

Figure 6:
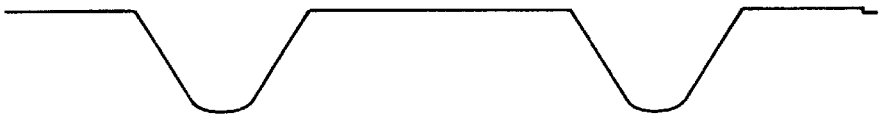
FIG. 6 is a top view of an outline of an individual wall panel support unit having a pair of corrugated ridges and corresponding furrows.

The invention wall support unit and wall system, broadly considered, includes a wall system assembly 10, which in turn includes as major components, a plurality of wall panel support units 20, a first or upper track member 30 and a second or lower track member 40.

The wall system assembly 10 is configured for installation between an existing ceiling or overhead 11 and a floor or base assembly 12.

The wall panel support unit 20 is comprised of rigid material and in practice may be constructed of extruded metal, including, but not limited to, aluminum, composition material, including, but not limited to, a particle board composite, plastic polymer, fiberglass or other material which may be formed or extended to form a rigid member.

Unit 20 may be generally described as a rigid sheet member with a first outwardly or exterior broad surface 21 and an oppositely outwardly or exterior broad surface 22. Broad surfaces 21 and 22 define a substantially uniform thickness A throughout unit 20.

Unit 20 has an upper edge 23 and a lower edge 24, a first linear side edge 25 and a second linear side edge 26. Upper edge 23 and lower edge 24 are substantially in parallel, and side edge 25 and side edge 26 are substantially in parallel. When viewed from a side perspective, the outline or profile formed by the boundary of upper edge 23, lower edge 24, first side edge 25 and second side edge 26 is generally rectangular. Although unit 20 may be fabricated in any rectangular configuration, in the preferred embodiment side edges 25 and 26 will be significant greater in length than upper edge 23 and lower edge 24. Unit 20 is further of corrugated construction and in that regard, first exterior broad surface 21 additionally defines a plurality or series of uniform ridges 27. Each uniform ridge 27 extends between upper edge 23 and lower edge 24 on broad surface 21, generally in parallel with side edges 25 and 26. In the preferred embodiment, each uniform ridge 27 is spaced at an equal interval B from any adjoining ridge 27. These intervals B would normally be at standard building specifications. The uniform ridges function in the same manner as traditional vertical studs to secure drywall, wood panels or other wall sheathing material.

Figure 7:
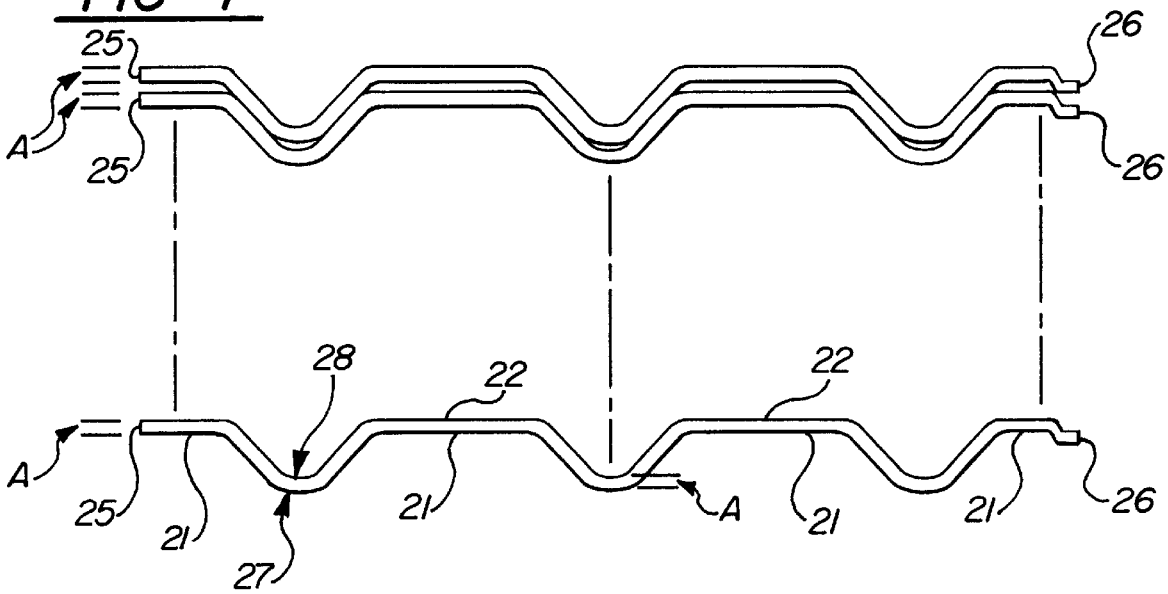
FIG. 7 is an exploded side view of three units in a stacked configuration.
Figure 8:
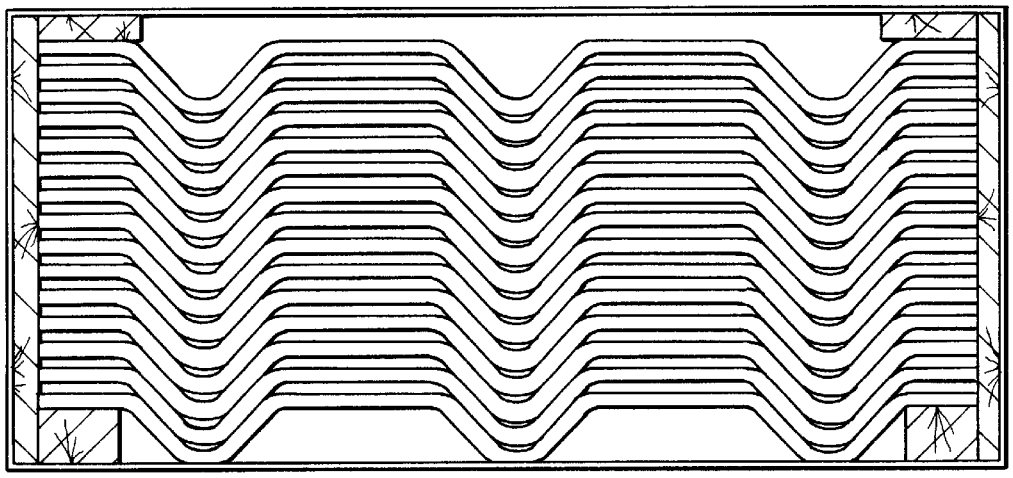
FIG. 8 is a perspective side view of a combination of individual units stacked within a shipping container.

Corresponding to the uniform ridges 27 on surface 21, surface 22 defines an equal series or plurality of uniform furrows 28. Each furrow 28 is aligned correspondingly with a ridge 27 between the upper edge 23 and lower edge 24 and is likewise substantially vertically parallel with edges 26 and 27. As may seem apparent from the views of FIGS. 7 and 8 and the cross-sectional view of FIG. 2, the corresponding alignment of each furrow 28 with a ridge 27 maintains the uniform thickness A. Each uniform ridge has a width C at where it conmmences extension from the broad surface 21 and further has a generally planar linear surface 29, which surface 29 is generally parallel to rectangular outline or profit of unit 20 at the point of furthest extension of ridge 27 from broad surface 21. Surface 29 has a width D and ridge 27 is progressively narrower from width C to width D as it extends from surface 21 to its furthest extension at surface 29. Furrow 28 corresponds in its dimensions, maintaining thickness A and thus the outer dimension of each ridge 27 is compatible with and insertable into a corresponding furrow 28 of a like or second unit 20 along its entire length between upper edge 23 and lower edge 24. As demonstrated in FIGS. 7 and 8, the conformable dimensions of each ridge 27 and its corresponding furrow 28 allow various numbers of unit 10 to be stacked for shipping or storage, on or off site, with maximum handling and space efficiency.

Each wall panel support unit 20 in the preferred embodiment also has a flat recessed surface area 50 on its second exterior broad surface 22 and a corresponding flat protrusion 51 on the first exterior broad surface 21. Recessed areas 50 and corresponding protrusion 51 are substantially in parallel, maintaining uniform thickness A of unit 20, and both recessed area 50 and corresponding protrusion 51 run vertically between upper edge 23 and lower edge 24, adjacent to second side edge 26. As shown in the cross-sectional view of FIG. 2, recessed surface area 50 of unit 20 is configured to facilitate a mating with another, like, unit 20 by interfacing, by forming a common boundary therewith, with a corresponding area of the first exterior broad surface 21 of the like unit 20, which corresponding area is adjacent to the first linear side edge 25 and runs vertically between upper edge 23 and lower edge 24 of the adjoining like unit 20.

In the preferred embodiment of the invention a first series or plurality of pre-drilled holes or apertures 52 extending through thickness A between surface 21 and surface 22 are located on recessed area 50 and corresponding protrusion 51, linearly aligned between upper edge 23 and lower edge 24 in parallel to second side edge 26. A corresponding second series or plurality of pre-drilled holes or apertures 53, running through thickness A between surface 21 and surface 22 is linearly aligned between upper edge 23 and lower edge 24, adjacent and parallel to first side edge 25. The first plurality of pre-drilled holes 52 and second plurality of pre-drilled holes 53 are configured and aligned so that each pre-drilled hole 52 in the first plurality and its corresponding pre-drilled hole 53 in the second plurality are linearly equidistant from upper edge 23 and lower edge 24 and are further configured and aligned so that when two units 20 are mated by interface between the recessed area 50 of one unit 20 and a portion of the first broad surface area 21 of a second unit 20 adjacent to the first side edge 23 of the second unit 20, each pre-drilled hole 52 of the first unit 20 corresponds with a pre-drilled hole 53 of the second unit 20 so as to provide a continuous opening or aperture through the two interfaced units 20, wherein the units may be mated by a plurality of fasteners 54 inserted through each pair of aligned pre-drilled holes 52 and 53. In the preferred embodiment, each fastener 54 may be a screw, bolt, rivet or other fastening means.

In the preferred embodiment of the invention, in unit 20, each uniform ridge 27 and corresponding uniform furrow 28 have a series or plurality of openings or apertures 55 linearly spaced between the upper edge 23 and lower edge 24. A plurality of these openings 55 are located on the side of each ridge 28 between the planar linear surface 29 and first side edge 25 and a plurality of openings 55 are located on the side of each ridge 28 between the planar linear surface 29 and the second side edge 26. These openings 55 may be utilized to pass electrical conduits, telephone or computer wire, other utilities or like purposes.

Upper track member 30 is constructed of a first rectangular bar element 31 and a second rectangular bar element 32. First bar element 31 has an outward or exterior linear planar surface 33 and an interior linear planar surface 34. Second bar element 32 has an outward or exterior linear planar surface 35 and an interior linear planar surface 36. First bar element 31 and second bar element 32 are joined together linearly at right angles at a common edge 37, so that the joined first bar element 31 and second bar element 32 form an L-shaped cross section.

Lower track member 40 is constructed of a first rectangular bar element 41 and a second rectangular bar element 42. First bar element 41 has an outward or exterior linear planar surface 43 and an interior linear planar surface 44. Second bar element 42 has an outward or exterior linear planar surface 45 and an interior linear planar surface 46. First bar element 41 and second bar element 42 are joined together linearly at right angles at a common edge 47, so that the joined first bar element 41 and second bar element 42 form an L-shaped cross section.

In the preferred embodiment of the invention, the outward linear planar surface 33 of the first bar element 31 track member 30 is configured to attach linearly to the ceiling 11 with the second bar element 32 extending downward at right angles from the ceiling along common edge 37.

In the preferred embodiment of the invention, the outward linear planar surface 43 of the first bar element 41 of second track member 40 is configured to attach linearly to the floor 12 with the second bar element 42 extending upward at right angles from the floor along common edge 47.

In a preferred embodiment of the invention, upper track member 30 and lower track member 40 additionally have, along their first rectangular bar elements 31 and 41, respectively, a series of pre-drilled holes 60 which may be utilized in conjunction with a fastening means for affixing upper track 30 to the ceiling 11 and lower track 40 to the floor 12, respectively, by passing fastening means through such pre-drilled holes, or apertures 60.

In the preferred embodiment of the invention, upper track member 30 and lower track member 40 additionally have a series or plurality of apertures consisting of pre-drilled holes 61 extending through second bar elements 32 and 42, respectively, and aligned linearly along the length of bar elements 32 and 42 respectively. Each support unit 20 further has a pair of series of pre-drilled holes 62 running between first broad surface area 21 and second broad surface areas 22, with a first series thereof linearly aligned and adjacent to upper edge 23 and running between side edge 25 and side edge 26 and a second series thereof linearly aligned and adjacent to lower edge 24 and running between side edge 25 and side edge 26. In the first series of pre-drilled holes 62 each hole 62 is located and configured to correspond with one or more of the pre-drilled holes 61 in upper support member 30 and in the second series of pre-drilled holes 62, each hole 62 is located and configured with one or more of the pre-drilled holes 61 in the lower support member 40, so that when one or more units 20 are placed against upper tracks 30 and 40, they may be held in place by a fastening means 63 running through one or more of the aligned pre-drilled holes 61 and 62

Accordingly, the wall system assembly 10 includes a plurality or series of units 20, affixed as stated, to a combination of an upper track member 30 and lower track member 40 arranged in vertical parallel, as set forth in FIG. 1.

Whereas, a preferred embodiment of the invention has been illustrated and described in detail, it will be apparent that various changes may be made in the disclosed embodiment without departing from the spirit of the invention.

What is claimed is:

1. A prefabricated wall panel support unit configured to receive a wall panel sheathing comprising:

a rigid sheet member, further comprising:

a first exterior broad surface and a corresponding second exterior broad surface, in combination defining a substantially uniform thickness;

an upper edge and a lower edge substantially in parallel, and a first linear side edge and a second linear side edge substantially in parallel, said upper edge, lower edge, first linear side edge and second linear side edge defining a rectangular profile;

said rigid sheet member being corrugated by a plurality of uniform ridges extending between said upper edge and lower edge on the first exterior broad surface generally in parallel with the first linear side edge and second linear side edge and a plurality of uniform furrows in the second exterior broad surface, with each furrow aligned correspondingly between said upper edge and lower edge, maintaining said substantially uniform thickness of said rigid sheet member;

each uniform ridge having an extended generally planar linear surface and parallel to said rectangular profile of the rigid sheet member;

each uniform ridge being progressively narrower from the first exterior broad surface of the rigid sheet member to the extended generally planar linear surface of the uniform ridge; and said rigid sheet member having a recessed surface area on the second exterior broad surface and a corresponding protrusion on the first exterior broad surface said recessed area and corresponding protrusion being in parallel, adjacent to the second linear side edge and between the upper edge and lower edge, said recessed surface area being configured to mate with a like rigid sheet member by interfacing with a corresponding area of the first exterior broad surface adjacent to the first linear side edge and running between the upper edge and lower edge of said like rigid sheet member.

2. A prefabricated wall panel support unit according to claim 1, wherein:

said recessed surface area and corresponding protrusion further define a first plurality of apertures running between the first exterior broad surface and the second exterior broad surface, aligned in parallel to said second linear side edge and a corresponding second plurality of apertures running between said first exterior broad surface and second exterior broad surface, aligned in parallel with the first linear side edge, said first plurality of apertures and second plurality of apertures configured so that each aperture in said first plurality and its corresponding aperture in said second plurality are linearly equidistant from the upper edge and lower edge of said rigid sheet member.

3. A prefabricated wall panel support unit according to claim 1, wherein:

each uniform ridge and the corresponding uniform furrow are configured so that the plurality of uniform ridges will fit within the corresponding plurality of uniform furrows of a like rigid sheet member.

4. A prefabricated wall panel support unit according to claim 3, wherein:

each uniform ridge and corresponding uniform furrow further define a plurality of apertures linearly spaced between the upper edge and lower edge of the rigid sheet member, said apertures extending between the generally planar linear surface of the uniform ridge and the first linear side edge and a corresponding plurality of apertures correspondingly linearly spaced between the upper edge and lower edge of the rigid sheet member, said apertures extending between the generally planar linear surface of the uniform ridge and the second linear side edge.

5. A prefabricated wall panel support unit according to claim 1, wherein:

the rigid support member is comprised of extruded metal.

6. A prefabricated wall panel support unit according to claim 1, wherein:

the rigid support member is comprised of an extruded composite material.

7. A prefabricated wall panel support unit according to claim 1, wherein:

the rigid support member is comprised of extruded plastic.

8. A system of constructing a wall extending between a floor element and an overhead element, said wall being configured to receive a wall panel sheathing, comprising:

a plurality of uniform prefabricated wall panel support units, each further comprising:

a rigid sheet member, further comprising:

a first exterior broad surface and a corresponding second exterior broad surface, in combination defining a substantially uniform thickness;

an upper edge and a lower edge substantially in parallel, and a first linear side edge and a second linear edge substantially in parallel, said upper edge, lower edge, first linear side edge and second linear side edge defining a rectangular profile;

each rigid sheet member being corrugated by a plurality of uniform ridges extending between said upper edge and lower edge on the first exterior surface generally in parallel with the first linear side edge and second linear side edge and a plurality of uniform furrows in the second exterior broad surface with each furrow aligned correspondingly between said upper edge and lower edge, maintaining said substantially uniform thickness of said rigid sheet member; each uniform ridge having an extended generally planar linear surface area parallel to said profile of the rigid sheet member;

each uniform ridge being progressively narrower from the first exterior broad surface of the rigid sheet member to the extended generally planar linear surface of the uniform ridge; and said rigid sheet member having a recessed surface area on the second exterior broad surface and a corresponding protrusion on the first exterior broad surface, said recessed area and corresponding protrusion being in parallel, adjacent to the second linear side edge and between the upper edge and lower edge of said rigid sheet member; said recessed surface area being configured to mate with a like rigid sheet member by interfacing with a corresponding area of the second exterior broad surface adjacent the first linear side edge and running between the upper edge and lower edge of said like rigid sheet member;

said recessed surface area and corresponding protrusion further defining a first plurality of apertures running between the first exterior broad surface and the second exterior broad surface, aligned in parallel to said second linear side edge and a corresponding second plurality of apertures being defined by and running between said first exterior broad surface and second exterior broad surface, aligned in parallel with the first linear side edge, said first plurality of apertures and second plurality of apertures configured so that each aperture in said first plurality of apertures and its corresponding aperture in said second plurality of apertures of a like member and its corresponding aperture in said second plurality of apertures are linearly equidistant from the upper edge and lower edge of said rigid sheet member, wherein, a first rigid sheet member is matable through its first plurality of apertures to a second rigid sheet member, through its second plurality of apertures; and a first fastening means for mating said rigid sheet members;

a first track configured to attach linearly to the overhead element and further configured to attach linearly to said plurality of rigid sheet members along the respective upper edges of said rigid sheet members;

a second track configured to attach linearly to the floor element and further configured to attach linearly to said plurality of rigid sheet members along the respective lower edges of said rigid sheet members;

a second fastening means for mating said plurality of rigid sheet members along their respective upper edges to said first track and along the respective lower edges of said plurality of rigid sheet members to said second track.

9. A system of constructing a wall extending between a floor element and an overhead element according to claim 8, wherein:

each uniform ridge and corresponding uniform furrow of each rigid sheet member further defines a plurality of apertures linearly spaced between the upper edge and lower edge of each rigid sheet member, said apertures extending between the generally planar linear surface of each uniform ridge and a first linear side edge, and a corresponding plurality of apertures correspondingly linearly spaced between the upper edge and lower edge of the rigid sheet member, said corresponding apertures extending between the generally planar linear surface of the uniform ridge and the second linearly side edge.

10. A system of constructing a wall extending between a floor element and an overhead element according to claim 8, wherein:

the rigid support member is comprised of extruded metal.

11. A system of constructing a wall extending between a floor element and an overhead element according to claim 8, wherein:

the rigid support member is comprised of extruded composite material.

12. A system of constructing a wall extending between a floor element and an overhead element according to claim 8, wherein:

the rigid support member is comprised of extruded plastic.

13. A system of constructing a wall extending between a floor element and an overhead element according to claim 8, wherein:

said first track and second track each further comprise a first rectangular bar element having an outward linear planar surface and an interior linear planar surface and a second rectangular bar element having an exterior linear planar surface and an interior linear planar surface, said first rectangular bar element and second rectangular bar element joined together at right angles at a common edge, forming an L-shaped cross section.

14. A system of constructing a wall extending between a floor element and an overhead element according to claim 13, wherein:

said outward linear planar surface of the first rectangular bar element of the first track is configured to attach linearly to the overhead element with the second rectangular bar element of said first track extending downward from said overhead element.

15. A system of constructing a wall extending between a floor element and an overhead element according to claim 14, wherein:

said first rectangular bar element of said first track defines a series of apertures extending between the outward linear planar surface and the interior linear planar surface, and said second rectangular bar element of said first track defines a series of apertures extending between its outward linear planar surface and interior linear planar surface, and each rigid support member further defines a plurality of apertures along its upper edge between the first exterior broad surface and second exterior broad surface, each of said apertures on the rigid support member located and configured to correspond with one or more apertures defined by the second rectangular bar element.

16. A system of constructing a wall extending between a floor element and an overhead element according to claim 13, wherein:

said outward linear planar surface of the first rectangular bar element of the second track is configured to attach linearly to the floor element with the second rectangular bar element extending upward from said floor element.

17. A system of constructing a wall extending between a floor element and an overhead element according to claim 16, wherein:

said first rectangular bar element of the second track defines a series of apertures extending between the outward linear planar surface and the interior linear planar surface, and said second rectangular bar element defines a series of apertures extending between its outward linear planar surface and interior linear planar surface, and each rigid support member further defines a plurality of apertures along its upper edge between the first exterior broad surface and second exterior broad surface, each of said apertures on the rigid support member located and configured to correspond with one or more apertures defined by the second rectangular bar element.

* * * * *